US007736164B2

(12) United States Patent
Okamura

(10) Patent No.: US 7,736,164 B2
(45) Date of Patent: Jun. 15, 2010

(54) CIRCUIT BOARD ELECTRICAL CONNECTOR

(75) Inventor: Seiji Okamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 48 days.

(21) Appl. No.: 12/220,000

(22) Filed: Jul. 31, 2008

(65) Prior Publication Data

US 2009/0035956 A1 Feb. 5, 2009

(30) Foreign Application Priority Data

Aug. 3, 2007 (JP) ..... 2007-202997

(51) Int. Cl.
*H01R 13/15* (2006.01)

(52) U.S. Cl. ..... 439/260; 439/495; 439/108; 439/607.36

(58) Field of Classification Search ..... 439/260, 439/495, 108, 607.36, 607.35
See application file for complete search history.

(56) References Cited

U.S. PATENT DOCUMENTS 6,902,425 B2 * 6/2005 Huang ..... 439/495
6,994,591 B2 * 2/2006 Huang ..... 439/607.36
7,001,208 B2 * 2/2006 Huang ..... 439/495
7,172,445 B2 * 2/2007 Shimoyama ..... 439/260
2007/0066115 A1 * 3/2007 Saito et al. ..... 439/260

FOREIGN PATENT DOCUMENTS

JP 2000-021525 A 1/2000
JP 2006-073206 A 3/2006
JP 2006-134708 5/2006
JP 2006-338920 A 12/2006

* cited by examiner

*Primary Examiner*—Gary F. Paumen
(74) *Attorney, Agent, or Firm*—Kubotera & Associates, LLC

(57) ABSTRACT

An electrical circuit board connector includes a housing made of an electrical insulating material; a groove formed in the housing for receiving a flat conductive member from a rear side of the housing; a signal terminal arranged at a front side of the housing; a ground terminal disposed at a position closer to the rear side relative to the signal terminal; and a pressing member supported to be movable. The signal terminal includes a contact arm, a first contact section for contacting with a circuit section of the flat conductive member, and a connecting section protruding outside the housing. The ground terminal includes a second contact section for contacting with a ground plate of the flat conductive member. When the pressing member moves, the pressing member presses the flat conductive member to the first contact section and the second contact section.

7 Claims, 4 Drawing Sheets

CIRCUIT BOARD ELECTRICAL CONNECTOR

BACKGROUND OF THE INVENTION AND RELATED ART STATEMENT

The present invention relates to a circuit board electrical connector. Especially, the present invention relates to a circuit board electrical connector having a ground terminal to be connected to a ground plate of a flat conductive member.

Patent Reference has disclosed a conventional circuit board electrical connector. In the conventional circuit board electrical connector disclosed in Patent Reference, a housing mounted on a circuit board includes a guide groove for inserting a flat conductive member in a direction substantially horizontal to the circuit board; and a plurality of flat signal terminals arranged in a width direction of the flat conductive member for contacting with and connecting to the flat conductive member. Patent Reference: Japanese Patent Publication No. 2006-134708A When the flat conductive member includes a ground plate, the conventional circuit board connector has a ground terminal corresponding to the ground plate. In the conventional circuit board connector disclosed in Patent Reference, the ground terminal is provided adjacent to the signal terminals outside a region where the signal terminals are arranged. The ground terminal is formed of a curved sheet metal.

In the conventional circuit board electrical connector disclosed in Patent Reference, the ground terminal is provided adjacent to the signal terminals at both ends in the arrangement direction. Therefore, the number and the position of the ground terminal in the arrangement direction are limited, and it is difficult to optionally select according to a design. As a result, it is difficult to improve grounding and control electrical characteristics according to a signal speed.

In view of the problems described above, an object of the invention is to provide an electrical circuit board connector, in which it is possible to optionally change the number and a position of a ground terminal in a terminal arrangement direction.

Further objects and advantages of the invention will be apparent from the following description of the invention.

SUMMARY OF THE INVENTION

In order to attain the objects described above, according to the present invention, in an electrical circuit board connector, a groove is formed in a housing made of an electrical insulating material. The groove opens at a rear side of the housing so as to be able to receive a front edge of a connecting section of a flat conductive member in the housing. A plurality of signal terminals is arranged in the housing along a width direction of the flat conductive member.

Further, the signal terminals mounted at a front side of the housing have contact arms extending backward. Contact sections formed at rear ends of the contact arms are situated in the guide groove so as to contact with a corresponding circuit section of the flat conductive member. Connecting sections with a protrusion shape formed at front ends of the signal terminals protrude outside the housing. A contact section of a ground terminal is positioned so as to contact with a ground plate of the flat conductive member. A pressing member is supported to be movable. When the pressing member moves, the pressing member presses the flat conductive member to the contact sections of the signal terminals and the contact sections of the ground terminals.

In the electrical connector according to the invention, a plurality of ground terminals is attached at a rear side of the housing, and the contact sections of the ground terminals are positioned backward than the contact sections of the signal terminals.

In the invention as described above, the signal terminals are arranged at the front side of the housing, and the ground terminals are attached at the rear side of the housing. Accordingly, a desired number of the ground terminals can be disposed at desired positions corresponding to an arbitrary number of the signal terminals in the terminal arrangement direction regardless of the number or positions of the signal terminals.

In addition, the signal terminals do not have to be removed upon arranging the ground terminals. Accordingly, it is not necessary to reduce the number of the signal terminals. Accordingly, the number of the ground terminals and the positions thereof in the terminal arrangement direction can be freely set and changed, thereby improving flexibility in a design.

As described above, according to the invention, the number and the positions of the ground terminals in the terminal arrangement direction are freely set, so that the ground terminals can be provided at the same positions in the arrangement direction as those of an arbitrary number of the signal terminals.

More specifically, according to the invention, the signal terminals are mounted from the front side of the housing into the terminal groove formed across the housing in a front-to-back direction. The ground terminal can be mounted at a rear side in the terminal groove of the corresponding signal terminal.

In the invention, in order to impart a shielding effect to the signal terminal, the housing may have a shielding plate. The shielding plate includes an upper plate that covers of the signal terminals in an arrangement range thereof from thereabove; side plates that are bent downward at both edges in the arrangement direction of the signal terminals; and legs provided at lower edges of the side plates to mount the housing on a circuit board.

In the invention, the side plates may have a support member to support a shaft section formed at edges of the pressing member, so that the shielding plate imparts high strength as an additional function being a support member made of metal in addition to simply imparting the shielding effect.

As described above, according to the invention, the signal terminals are disposed at the front side of the housing, and the ground terminals are disposed at the rear side thereof. Therefore, any number of the ground terminals may be disposed at any positions within the arrangement range regardless of the number or the positions of the signal terminals in the arrangement range thereof. The number and the positions of the ground terminals may be suitably selected according to a condition of a design.

Accordingly, it is possible to improve grounding and control electric characteristics according to a signal speed. In addition, the flat conductive member has the signal circuit exposed at the front side and the ground plate provided behind the signal circuit. Accordingly, the arrangement of the signal terminals and the ground terminals in the front-to-back direction is compatible with a configuration of the flat conductive member, thereby making a design of the ground terminals simple and reducing a size thereof.

BRIEF DESCRIPTION OF THE DRAWINGS

FIGS. 3(A) and 3(B) are sectional view showing a flat conductive member according to the embodiment of the present invention, wherein FIG. 3(A) is a sectional view of the flat conductive member taken along a longitudinal direction thereof, and FIG. 3(B) is a sectional view of the flat conductive member taken along a line 3(B)-3(B) in FIG. 3(A); and FIGS. 4(A) to 4(C) are sectional views showing the electrical circuit board connector according to the embodiment of the present invention in a state that a pressing member is situated at a closed position, wherein FIG. 4(A) is a sectional view of the electrical circuit board connector taken at a position where both a signal terminal and a ground terminal are situated in a terminal arrangement direction, FIG. 4(B) is a sectional view of the electrical circuit board connector taken at a position where only the signal terminal is situated in the terminal arrangement direction, and FIG. 4(C) is a sectional view of the electrical circuit board connector taken at a position of a latching arm of a shielding member in the terminal arrangement direction.

DETAILED DESCRIPTION OF THE PREFERRED EMBODIMENTS

Hereunder, embodiments of the invention will be described with reference to accompanying drawings.

Figure 1:
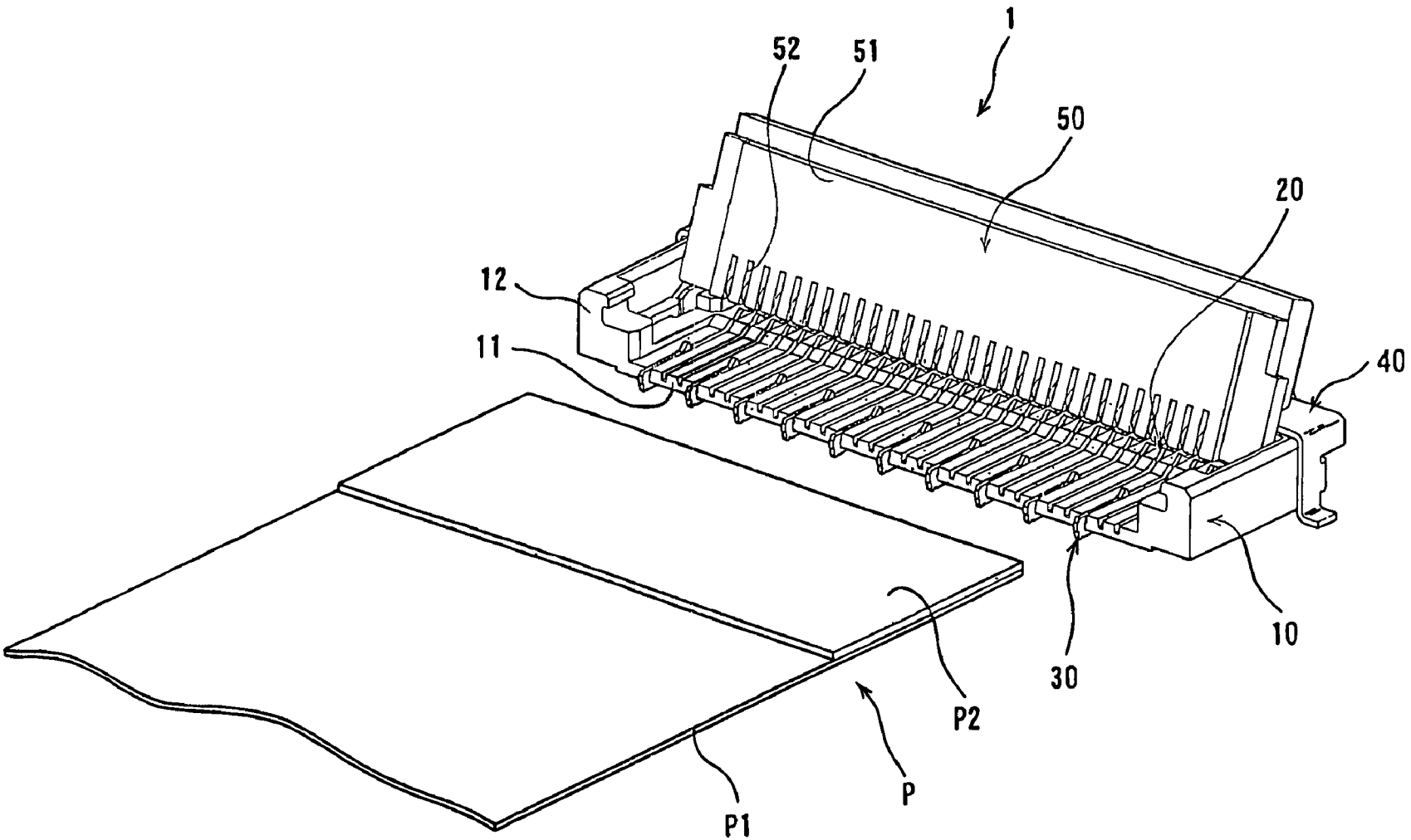
FIG. 1 is a view showing an electrical circuit board connector according to a first embodiment of the present invention.

FIG. 1 is a perspective view of an electrical circuit board connector 1 and a flat conductive member P such as FFC and FCP to be connected to the electrical circuit board connector 1 according to the embodiment of the present invention.

As shown in FIG. 1, the connector 1 includes a housing 10 made of an electrically insulating material; signal terminals 20 and ground terminals 30, which are held in the housing 10; a shielding member 40 to shield the signal terminals 20; and a pressing member 50 to press the flat conductive member P to the signal terminals 20 and the ground terminals 30.

Figure 2:
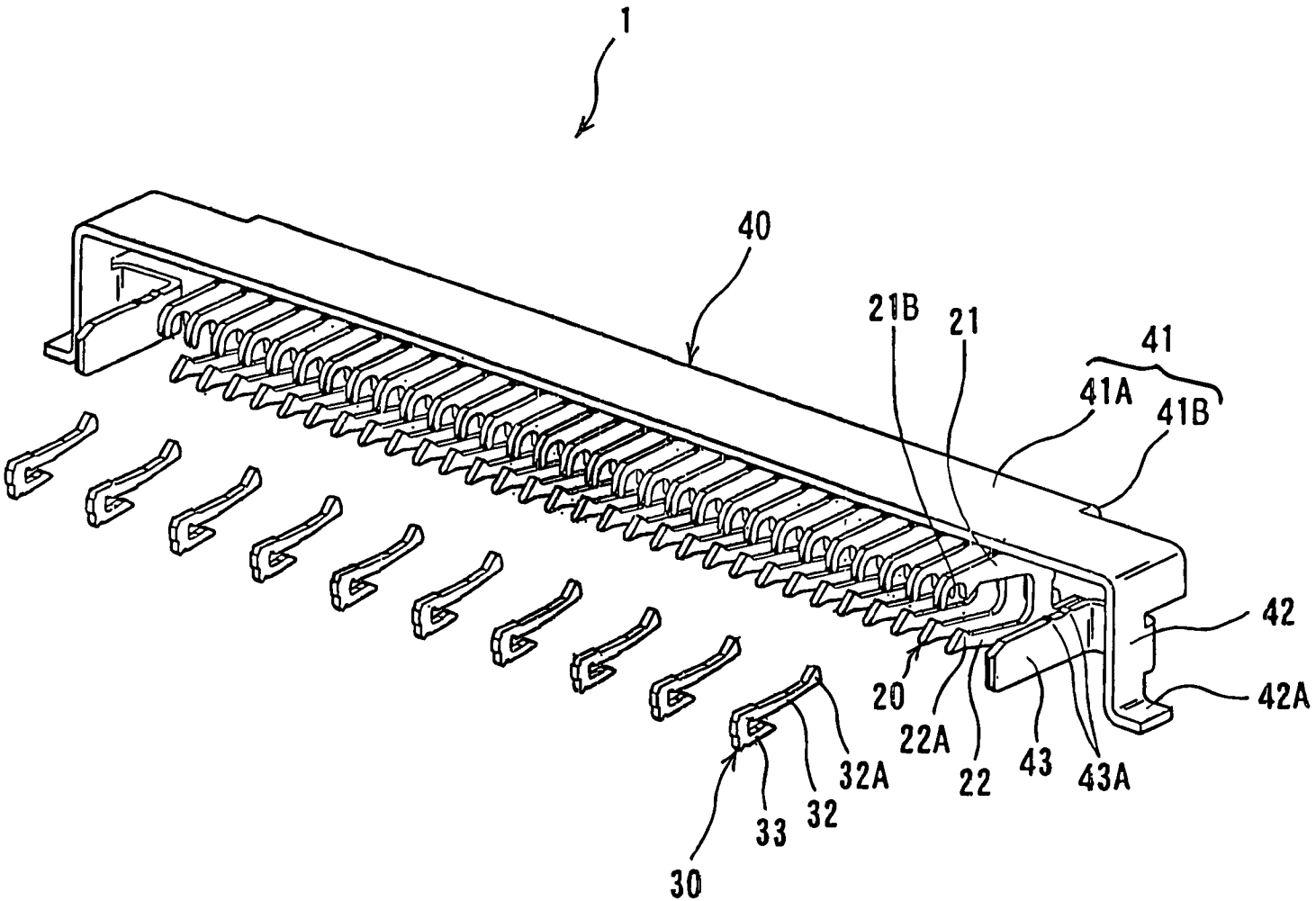
FIG. 2 is a perspective view showing the electrical circuit board connector according to the embodiment of the present invention.

FIG. 2 is a perspective view showing the electrical circuit board connector 1 according to the embodiment of the present invention. In FIG. 2, the housing 10 and the flat conductive member P are omitted, and the signal terminals 20, the ground terminals 30, and the shielding member 40 are shown for easier understanding.

Figure 3:
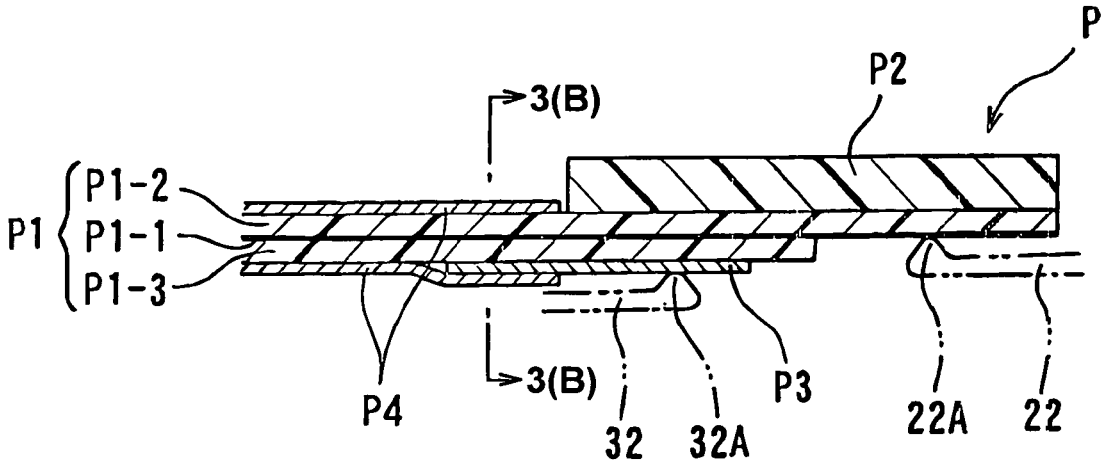
Figure 3:
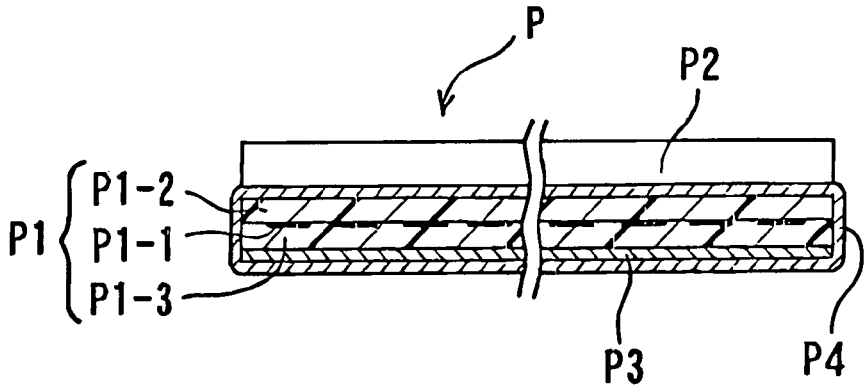

FIGS. 3(A) and 3(B) are sectional view showing the flat conductive member P according to the embodiment of the present invention. More specifically, FIG. 3(A) is a sectional view of the flat conductive member P taken along a longitudinal direction thereof, and FIG. 3(B) is a sectional view of the flat conductive member P taken along a line 3(B)-3(B) in FIG. 3(A).

Figure 4:
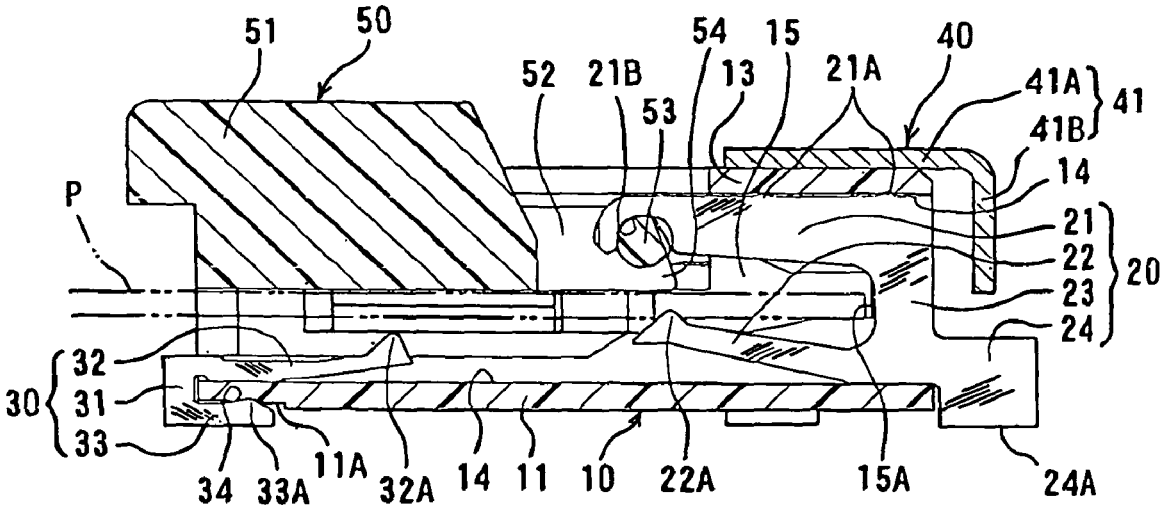
Figure 4:
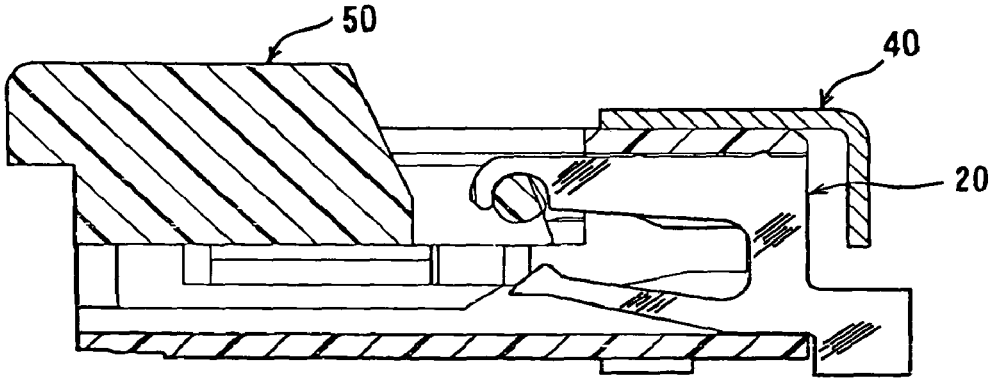
Figure 4:
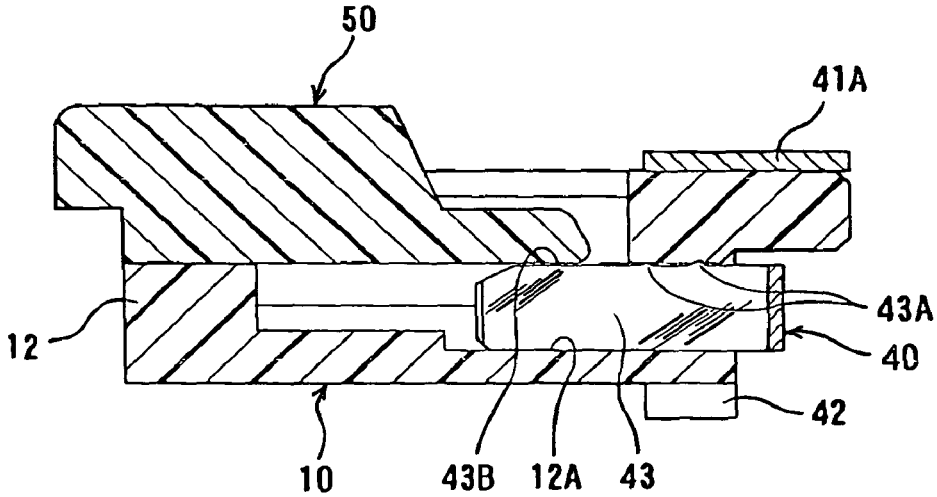

FIGS. 4(A) to 4(C) are sectional views showing the electrical circuit board connector 1 according to the embodiment of the present invention in a state that a pressing member 50 is situated at a closed position. More specifically, FIG. 4(A) is a sectional view of the electrical circuit board connector 1 taken at a position where both the signal terminal 20 and the ground terminal 30 are situated in a terminal arrangement direction, FIG. 4(B) is a sectional view of the electrical circuit board connector 1 taken at a position where only the signal terminal 20 is situated in the terminal arrangement direction, and FIG. 4(C) is a sectional view of the electrical circuit board connector 1 taken at a position of a latching arm 43 of a shielding member 40 in the terminal arrangement direction.

As shown in FIG. 2 and FIG. 4(A), the signal terminals 20 are made of a sheet metal maintaining a flat surface thereof. As shown in FIG. 4(A), each of the signal terminals 20 has a support arm 21 and a contact arm 22 or a contact section, which are horizontal to each other; a joining section 23 to join the support arm 21 and the contact arm 22; and a connecting section 24 that extends from a lower end of the joining section 23 to outside of the housing 10.

As shown in FIG. 4(A), the support arm 21 extends leftward from an upper part of the joining section 23 provided on a right side of the housing 10, and reaches a middle part of the housing 10. The support arm 21 has a relatively large width (a dimension in a height direction in FIG. 4(A)) and has high rigidity. The support arm 21 has latching protrusions 21A on an upper side thereof and a shaft support section 21B of a concave shape on a lower side at a left end thereof.

The contact arm 22 that extends leftward from a lower end of the joining section 23 is slightly sloped upward a left side thereof, and has a protruding contact section 22A at an upper side at an end thereof. While the support arm 21 has a large width and high rigidity, the contact arm 22 has a small width and flexibility so as to displace in the height direction. The contact section 22A is provided near the shaft support section 21B in an extending direction of the contact arm 22.

The connecting section 24 extends rightward from the lower part of the joining section 23 toward outside the housing 10, and protrudes downward. A lower edge of the connecting section 24 protrudes through and below a bottom surface of the housing 10 and forms a soldering connecting edge 24A.

As shown in FIG. 2, the flat signal terminals 20 are arranged at a specific interval in between on a front side (on a right side in FIG. 4(A)) of the housing 10 along a plate thickness direction of the signal terminals 20 (a width direction of the connector 1 in FIG. 1).

As shown in FIG. 4(A), while the signal terminals 20 are attached at the front side of the housing 10, the ground terminals 30 are disposed on a rear side of the housing 10. Similarly to the signal terminals 20, each of the ground terminals 30 is also formed of a sheet metal maintaining a flat surface thereof, and has a contact arm 32 that extends rightward from an upper end of a joining section 31 and has an attachment arm 33 that extends rightward from a lower end thereof.

The attachment arm 33 is shorter than the contact arm 32, has rigidity, and forms an attachment groove 34 with the contact arm 32. In the embodiment, while the attachment arm 33 has a latching protrusion 33A at a free end thereof, the contact arm 32 has a protruding contact section 32A at a free end thereof.

As shown in FIG. 2, the shielding member 40 that covers the signal terminals 20 from above includes a shielding plate 41 that extends to cover an arrangement region of the signal terminals 20; side plates 42 that perpendicularly extend downward and are bent at both edges of the shielding plate 41 in the terminal arrangement direction; and latching arms 43 that are bent so as to extend backward from inner sides of the side plates 42.

As shown in FIG. 4(A), the shielding plate 41 includes an upper plate 41A that is provided above the signal terminals 20 and a front plate 41B that is bent so as to perpendicularly extend downward from a front edge of the shielding plate 41.

As shown FIG. 4(A), in the terminal extending direction, the upper plate 41A covers from left ends of the support arms 21 to front side of the support arm 21 of the signal terminal, and the front plate 41B covers most part of the joining sections 23.

As shown in FIG. 2, each of the side plates 42 has a leg 42A formed by bending at a lower end thereof, and provides a large area for soldering onto a circuit board (not illustrated).

Each of the latching arms 43 is formed by bending the side plate 42 inward (in a direction toward a middle of the arrangement of the signal terminals 20) from a front-side edge of the side plate 42, and then again bending to extend backward in parallel to the signal terminal 20 at outermost positions. Each of the latching arms 43 has latching protrusions 43A at an upper edge thereof.

The signal terminals 20, the ground terminals 30, and the shielding member 40 are attached to the housing 10. The housing 10 includes an terminal arrangement plate 11 to dispose the signal terminals 20 and the ground terminals 30 on a bottom side thereof; sidewalls 12 perpendicularly provided at both side edges of the arrangement plate 11 being close to the signal terminals 20 and the ground terminals 30 at outermost positions; and a front wall 13 provided in the height direction at the front edge of the terminal arrangement plate 11 (Refer to FIGS. 1 and 4(A)).

Terminal grooves 14 that extend in the terminal extending direction and open upward are formed in an upper surface of the arrangement plate 11 for receiving the signal terminals 20. A groove width of the terminal grooves 14 is slightly larger than the plate thickness of the signal terminals 20 and the ground terminals 30. A groove depth of the terminal grooves 14 is set such that most parts of the contact arms 22 of the signal terminals 20 are placed therein and only the contact sections 22A protrude upward in the front part of the terminal arrangement plate 11. Further, most parts of the contact arms 32 of the ground terminals 30 are in the terminal grooves 14, and only the contact sections 32A protrude upward in the rear part of the terminal arrangement plate 11.

A rear edge of the terminal arrangement plate 11 has a dented section to form an attachment section 11A that has a slightly smaller thickness. A thickness of the attachment section 11A is slightly larger than a width of the attachment grooves 34 of the ground terminals 30.

The front wall 13 has slits to insert the signal terminals 20 from a front side, and the slits are connected to the terminal grooves 14 of the arrangement plate 11 provided thereunder. In other words, the terminal grooves 14 extend close to the upper edge of the front wall 13. A height of the terminal grooves 14 is substantially equal to that of the terminals 20 at a position of the joining section 23.

The front wall 13 extends such that guide grooves 15 that are opened backward are connected to all of the terminal grooves 14. As shown in FIG. 4(A), the guide groove 15 extends in the terminal arrangement direction. The guide groove 15 guides the flat conductive member P upon introducing from the front side, and the front inner edge 15A contacts with the front edge of the flat conductive member P and defines a position of the flat conductive member P.

As shown in FIG. 4(C), each of the sidewalls 12 that extends upright from the both side edges of the terminal arrangement plate 11 has a slit-like latching groove 12A to insert the latching arm 43 of the shielding member 40 therein.

In the housing 10 formed as described above, the signal terminals 20 are inserted from the front ends of the respective terminal grooves 14 and attached therein. Accordingly, the latching protrusions 21A are caught by the groove upper edge, and the signal terminals 20 are prevented from coming off therefrom.

On the other hand, the ground terminals 30 are attached from the rear edge to the selected terminal grooves 14 according to a design suitable for the connector. The attachment sections 11A are fitted in the attachment grooves 34 of the ground terminals 30, and the fitting latching protrusions 33A of the ground terminals 30 are latched in the lower surface of the attachment section 11A, and thereby the grounding terminals 30 hardly come off.

The pressing member 50 is made of an electrical insulating material similar to that of the housing 10, and has a flat shape having a width to cover the arrangement range of the signal terminals 20 as shown in FIG. 1. The pressing member 50 is supported for a pivotal movement with the shaft support sections 21B of the signal terminals 20 as shown in FIG. 4(A).

As shown in FIG. 1, the pressing member 50 has an operating section 51, and has grooves 52 that are provided at the lower part of the operating section 51 so as to be through in the thickness direction while opening at the lower edge. The grooves 52 are formed at positions corresponding to those of the respective signal terminals 20 in the terminal arrangement direction.

Each of the grooves 52 has an isolated shaft section 53 to connect with the facing inner surfaces (refer to FIG. 4(A)). The rear edges of the support arms 21 of the terminals 20 are inserted in the grooves 52, and the shaft sections 53 are supported from above by the shaft support sections 21B of the signal terminals 20. The pressing member 50 forms a pressing section 54 to press the flat conductive member P at the front lower edge thereof.

In the embodiment, the pressing member 50 is supported at the shaft sections 53 thereof on the shaft support sections 21B of the signal terminals 20. When the pressing member 50 pivotally moves to the close position shown in FIGS. 4(A) to 4(C), the shielding member 40 is mounted.

As shown in FIG. 4(C), the latching arm 43 of the shielding member 40 is inserted from the front side into the latching groove 12A of the housing 10, and the latching protrusions 43A are caught at the upper edge of the groove 12A, and thereby the position of the shielding member 40 is secured. In this state, the upper plate 41A of the shielding plate 41 of the shielding member 40 covers the support arms 21 of the signal terminals 20 from above, and the front plate 41B of the shielding plate 41 of the shielding member 40 covers from the front side (refer to FIGS. 4(A) and (B)).

As shown in FIG. 4(C), the latching arm 43 supports the corresponding section of the pressing member 50 with the upper edge 43B.

Next, the flat conductive member P will be described. As shown in FIG. 1, the flat conductive member P has a main body P1 and a reinforcing plate P2 attached to a front edge of the main body P1.

More specifically, as in FIGS. 3(A) and 3(B), the main body P1 integrally has an upper layer P1-2 that supports at a lower surface thereof a strip-like conductive wire P1-1 and a lower layer P1-3 that covers the conductive wire P1-1. The strip-like conductive wire P1-1 is arranged at a specified interval in between in a width direction of the flat conductive member P and extends in a longitudinal direction of the flat conductive member P.

The main body P1 is pre-treated upon use of the flat conductive member P. More specifically, as shown in FIG. 3(A), the lower layer P1-3 is removed at the front edge, and the conductive wire P1-1 is exposed.

Then, the reinforcing plate P2 is attached on an upper face of the upper layer P1-2 so as to cover a portion behind of the conductive wire P1-1 thus exposed in a conductor insertion direction. Subsequently, a thin ground plate P3 is provided so as to cover further behind than the reinforcing plate P2 in the conductor insertion direction. Shielding films P4 are provided so as to cover the whole area behind the reinforcing plate P3.

A method of using the connector 1 will be described next.

(1) First, the connecter 1 is mounted on a circuit board at a specified position. The connecting sections 24 of the signal terminals 20 are connected to a specified circuit unit by soldering at the soldering connecting edges 24A, which are the lower edges of the connecting sections 24. At the same time, the attachment arms 33 of the ground terminals 30 are attached to corresponding sections by soldering and electrically connected thereto, and the legs 42A formed at the lower edges of the side plates 42 of the shielding member 40 are also mounted on the circuit board by soldering.

(2) Subsequently, as shown in FIG. 1, the pressing member 50 moves by a pivotal action to the open position. When the pressing member 50 is situated at the open position, the housing 10 has the rear part of the guide grooves 15 opened, so that the flat conductive member P can be easily inserted therein.

(3) Thereafter, the front edge of the flat conductive member P (refer to FIG. 3) is inserted in the guide grooves 15 of the housing 10 until the front edge abuts against the front inner edge 15A (indicated with a phantom line in FIG. 4(A)). The conductive wire P1-1 exposed at the lower face of the front edge of the flat conductive member P is located on the contact sections 22A of the corresponding signal terminals 20, and the ground plate P3 provided at the back is located on the contact sections 32A of the ground terminals 30 (refer to FIG. 3(A)).

(4) Then, the pressing member 50 pivotally moves to the close position as shown in FIGS. 4(A) to 4(C). At the closed position, the pressing member 50 presses the flat conductive member P downward with the pressing section 54, so as to increase a contact pressure between the conductive wire P1-1 and the contact sections 22A of the signal terminals 20 and the contact pressure between the ground plate P1-2 and the contact sections 32A of the ground terminals 30, so that the connection is even more secured.

(5) In the embodiment, the number and positions of the ground terminals 30 may be freely set and changed. Accordingly, when an environment of the connector 1 varies, it is possible to mount most suitable number of the ground terminals 30 at the most suitable positions.

The disclosure of Japanese Patent Application No. 2007-202997, filed on Aug. 3, 2007 is incorporated in the application by reference.

While the invention has been explained with reference to the specific embodiments of the invention, the explanation is illustrative and the invention is limited only by the appended claims.

What is claimed is:

1. An electrical circuit board connector, comprising:

a housing made of an electrical insulating material;

a groove formed in the housing for receiving a flat conductive member from a rear side of the housing;

a signal terminal arranged at a front side of the housing, said signal terminal including a contact arm, a first contact section for contacting with a circuit section of the flat conductive member, and a connecting section protruding outside the housing;

a ground terminal disposed at a position closer to the rear side relative to the signal terminal, said ground terminal including a second contact section for contacting with a ground plate of the flat conductive member; and a pressing member supported to be movable for pressing the flat conductive member to the first contact section and the second contact section, wherein said housing includes a terminal groove for receiving the signal terminal and the ground terminal.

2. The electrical circuit board connector according to claim 1, wherein said ground terminal is situated at a position the same as that of the signal terminal in a width direction of the housing.

3. The electrical circuit board connector according to claim 1, further comprising a shielding plate, said shielding plate including an upper plate for covering of the signal terminal, a side plate, and a leg to be attached to a circuit board.

4. The electrical circuit board connector according to claim 3, wherein said pressing member includes a shaft portion supported on the side plate.

5. The electrical circuit board connector according to claim 1, wherein said housing includes a plurality of terminal grooves so that the ground terminal is disposed in one of the terminal grooves.

6. The electrical circuit board connector according to claim 1, wherein said signal terminal and said ground terminal have a substantially same thickness slightly smaller than a width of the terminal groove so that the signal terminal and the ground terminal are tightly fitted in the terminal groove.

7. The electrical circuit board connector according to claim 1, wherein said terminal groove includes a first terminal groove for receiving only the signal terminal and a second terminal groove for receiving both the signal terminal and the ground terminal.

* * * * *